US012672742B2

(12) United States Patent
Fan et al.

(10) Patent No.: US 12,672,742 B2
(45) Date of Patent: Jul. 7, 2026

(54) TOWEL HEATING DEVICE

(71) Applicant: Guangzhou Hansong Tuojiang Technology Co., Ltd., Guangzhou (CN)

(72) Inventors: Zhilin Fan, Guangzhou (CN); Zhenji Lin, Guangzhou (CN)

(73) Assignee: Guangzhou Hansong Tuojiang Technology Co., Ltd., Guangzhou (CN)

( * ) Notice: Subject to any disclaimer, the term of this patent is extended or adjusted under 35 U.S.C. 154(b) by 0 days.

(21) Appl. No.: 19/189,293

(22) Filed: Apr. 25, 2025

(65) Prior Publication Data

US 2025/0281008 A1 Sep. 11, 2025

Related U.S. Application Data

(63) Continuation-in-part of application No. 18/763,734, filed on Jul. 3, 2024, and a continuation-in-part of application No. 18/763,632, filed on Jul. 3, 2024.

(30) Foreign Application Priority Data

Mar. 7, 2024 (CN) ..... 202410260988.9
Mar. 7, 2024 (CN) ..... 202420441375.0
Apr. 8, 2025 (CN) ..... 202520656668.5

(51) Int. Cl.
*A47K 10/06* (2006.01)

(52) U.S. Cl.
CPC ..... *A47K 10/06* (2013.01)

(58) Field of Classification Search
CPC ..... A47K 10/00; A47K 10/06; A47K 10/16; A47K 10/24; A45C 15/00; A45C 3/001; A45C 7/0095; H05B 3/34
USPC ..... 219/521
See application file for complete search history.

(56) References Cited

U.S. PATENT DOCUMENTS 4,694,146 A * 9/1987 DeMars ..... D06F 58/16 219/385
4,761,974 A * 8/1988 Lii ..... E05B 37/02 70/4
4,927,995 A * 5/1990 Lovett ..... A47K 10/06 219/385
5,494,186 A * 2/1996 Marsh ..... A61B 50/36 220/837
6,080,974 A * 6/2000 Ambrosiano ..... H05B 3/286 392/416
2002/0153368 A1* 10/2002 Gardner ..... B32B 5/26 219/545
2004/0093758 A1* 5/2004 Miller ..... D06F 58/14 34/201
2005/0026495 A1* 2/2005 Zoller ..... B65H 75/4473 439/501
2006/0001727 A1* 1/2006 Haas ..... A41D 13/0051 347/194

(Continued)

*Primary Examiner* — Sang Y Paik

(57) ABSTRACT

A towel heating device includes a body portion, at least one heating plate and at least one heat insulation member, the body portion defines a heating chamber; each heating plate is mounted on the body portion; each heat insulation member is mounted in the heating chamber, and the heat insulation member is configured to separate or partially separate the heating plate from the heating chamber.

17 Claims, 11 Drawing Sheets

(56) References Cited

U.S. PATENT DOCUMENTS

| | | | | |
|---|---|---|---|---|
| 2010/0031678 | A1* | 2/2010 | Roman | F25D 3/12<br>248/213.2 |
| 2017/0022024 | A1* | 1/2017 | Rishwain | B65H 75/406 |
| 2019/0248211 | A1* | 8/2019 | Seki | H05B 3/34 |

* cited by examiner

TOWEL HEATING DEVICE

CROSS REFERENCE TO RELATED APPLICATIONS

The present application is a continuation-in-part application of the U.S. patent application Ser. No. 18/763,632 filed on Jul. 3, 2024; U.S. patent application Ser. No. 18/763,734 filed on Jul. 3, 2024, which claims the priority of: Chinese patent application No. CN202410260988.9, filed on Mar. 7, 2024; Chinese patent application No. CN202420441375.0, filed on Mar. 7, 2024; Chinese patent application No. CN202520656668.5, filed on Apr. 8, 2025.

FIELD

The present disclosure relates to the field of heating device, and particularly to a towel heating device.

BACKGROUND

The towel heating device has a heating chamber, which is heated by heating wires attached to a metal heating plate. However, in the related art, the metal heating plate of the towel heating device is directly exposed inside the heating chamber, If a user inserts limbs into the heating chamber, they may get burned due to the direct contact with the metal heating plate.

SUMMARY

A towel heating device includes a body portion, at least one heating plate and at least one heat insulation member, the body portion defines a heating chamber; each heating plate is mounted on the body portion; each heat insulation member is mounted in the heating chamber, and the heat insulation member is configured to separate or partially separate the heating plate from the heating chamber.

BRIEF DESCRIPTION OF THE DRAWINGS

To provide a clearer illustration of the technical solutions in the embodiments of the present disclosure or in the prior art, a brief introduction will be given to the drawings used in the description of the embodiments or the prior art. It is obvious that the drawings described below are merely some embodiments of the present disclosure, and for those skilled in the art, other drawings can be obtained based on these drawings without creative efforts.

REFERENCE NUMERALS IN THE DRAWINGS

Figure 1:
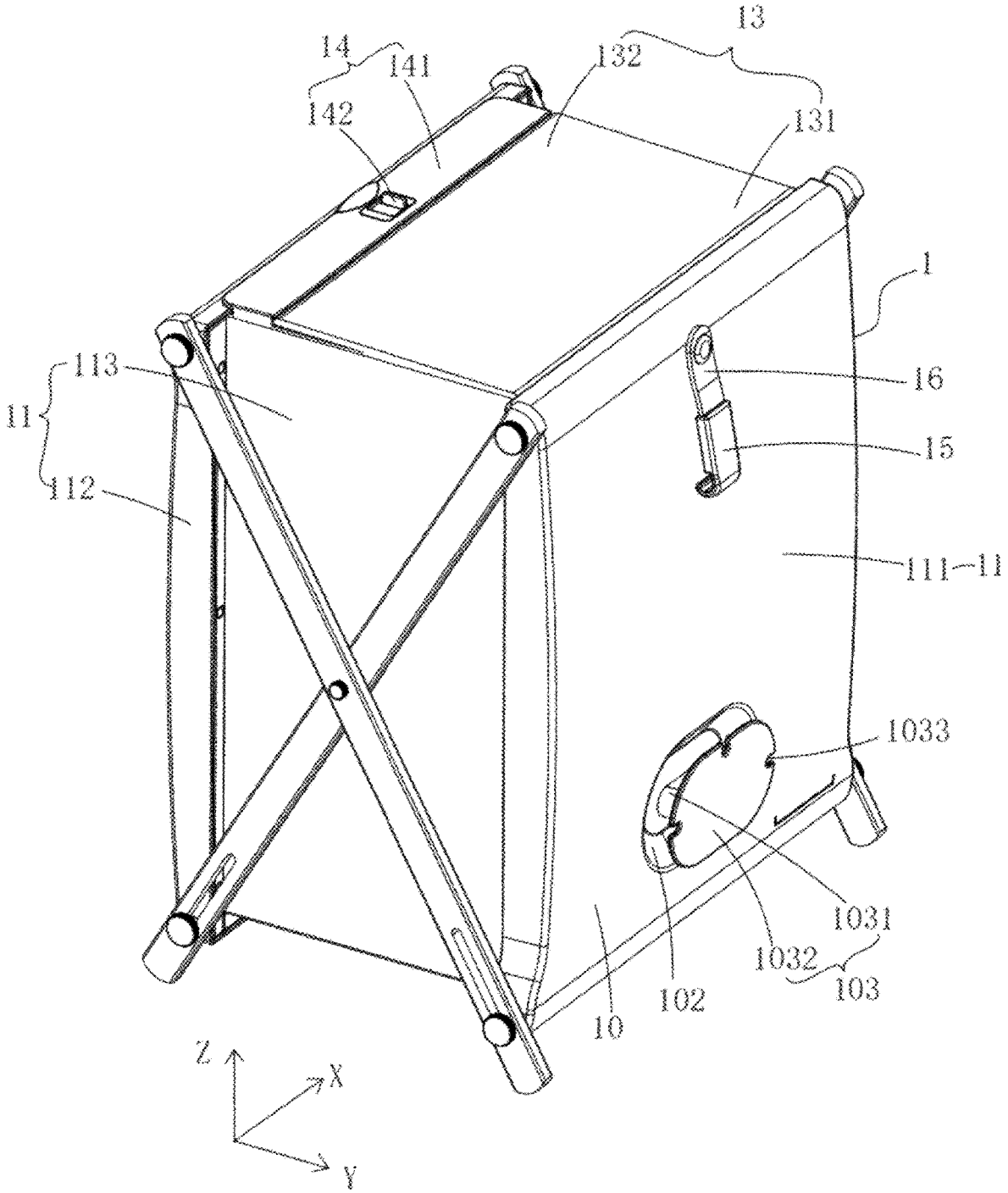
FIG. 1 is a structural schematic view of a towel heating device according to an embodiment of the present disclosure.
Figure 2:
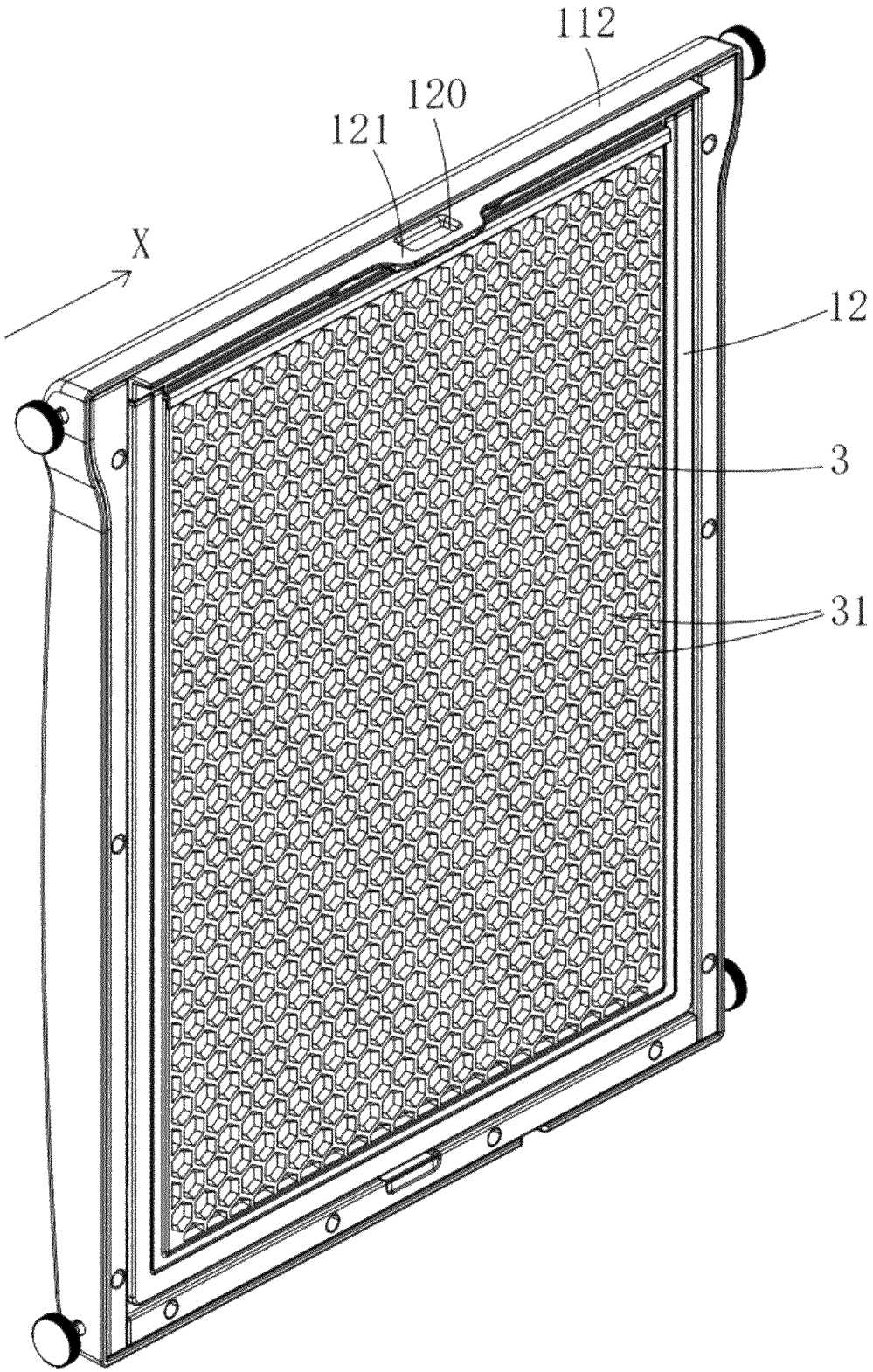
FIG. 2 is a schematic view showing the positional relationship between the second shell, the shell, and heat insulation member according to an embodiment.
Figure 3:
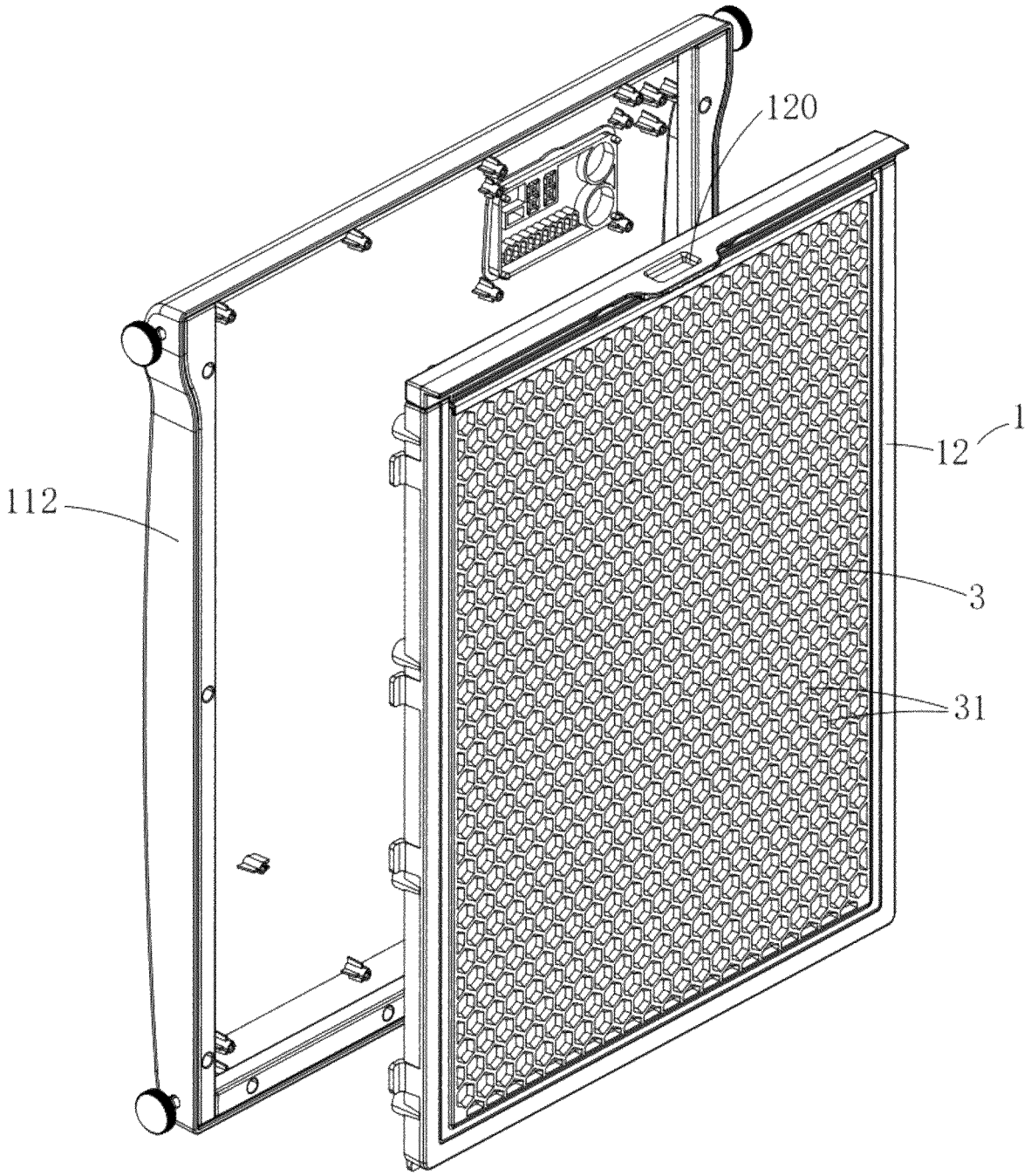
FIG. 3 is an exploded view of the second shell and the installation frame shown in FIG. 2.
Figure 4:
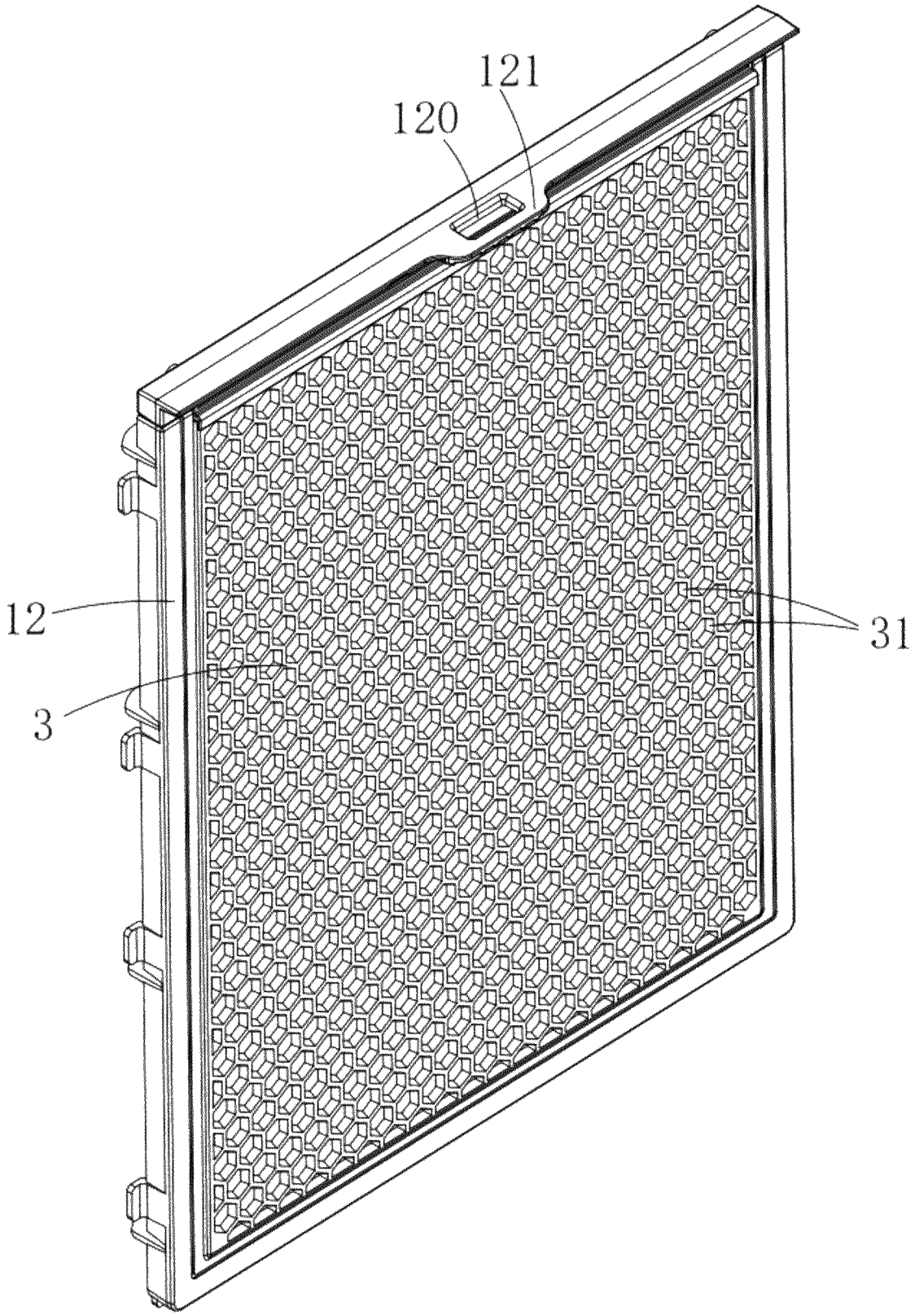
FIG. 4 is a structural schematic view of the shell and the heat insulation member according to an embodiment.

1, body portion; 10, outer wall of the body portion; 11, shell; 12, installation frame; 13, cover; 14, locking structure; 15, hook; 16, rope; 100, heating chamber; 101, opening; 102, recessed cavity; 103, wire winding structure; 111, first shell; 112, second shell; 113, foldable member; 120, snap slot; 121, connecting protrusion; 122, bottom surface; 123, abutment platform; 131, first end; 132, second end; 1322, avoidance groove; 141, connecting base; 142, sliding hook; 1031, winding rod; 1032, baffle; 1033, fixation notches; 1321, engagement block; 1411, upper base; 1412, lower base; 1413, engagement base; 1414, fixing posts; 1421, hook-shaped bottom; 1422, push-pull portion; 1423, sliding portion; 14111, lapping plate; 14112, first sliding slot; 14121, second sliding slot; 14211, vertical block; 14212, stopping block; 1131, first sheet portion; 1132, second sheet portion;

2, heating plate; 3, heat insulation member; 31, holes.

DETAILED DESCRIPTION

Unless otherwise defined, all technical and scientific terms used herein have the same meaning as commonly understood by those skilled in the art to which this disclosure belongs. The terms used in the description of the application herein are intended for describing particular embodiments only and are not intended to limit the present disclosure. In the description, claims, and the above drawings of the present disclosure, the terms "comprising" and "having", as well as their variants, are intended to convey a non-exclusive inclusion. The terms "first", "second", etc., as used herein, are intended to distinguish between different objects, rather than to describe a particular order.

Reference to "embodiments" herein implies that a particular feature, structure, or characteristic described in connection with an embodiment may be included in at least one embodiment of the present disclosure. The appearance of the phrase at various places in the specification does not necessarily refer to the same embodiment, nor is it a separate or alternative embodiment that is mutually exclusive of other embodiments. One skilled in the art would explicitly and implicitly understand that the embodiments described herein can be combined with other embodiments.

In order to enable those skilled in the art to better understand the technical solutions of the present disclosure, the technical solutions in the embodiments of the present disclosure will be clearly and completely described below with reference to the accompanying drawings.

As shown in FIGS. 1 to 12, the present disclosure provides a towel heating device including a body portion 1, at least one heating plate 2 and at least one heat insulation member 3.

In an embodiment, a heating chamber 100 is defined inside the body portion 1, a heating plate 2 is mounted on the body portion 1, and the heating plate 2 is made of metal material, such as a galvanized steel plate. A heating wire is mounted on and attached to the heating plate 2. The heating wire is able to generate heat when connected to a power source, and the heat is conducted to the heating plate 2 to expand a heating area, such that the heating plate 2 can heat the air inside the heating chamber 100 over a large area. A heat insulation member 3 is mounted in the heating chamber 100, the heat insulation member 3 is configured to separate or partially separate the heating plate 2 from the heating chamber, that is, the heat insulation member 3 is disposed on a side of the heating plate 2 facing the heating chamber 100. The heating plate 2 may generate a high temperature during operation, which may causing accidental burns if a limb of the user reaches into the heating chamber 100. However, a direct contact between the limb and the heating plate 2 can be prevented by the heat insulation member 3, such that the accidental burns can be avoid.

In an embodiment, as shown in FIG. 1, FIG. 2, FIG. 3 and FIG. 6, the body portion includes a shell 11 and an installation frame 12, the shell 11 includes a first shell 111, a second shell 112 and a foldable member 113 connecting the first shell 111 and the second shell 112 with each other. Both the first shell 111 and the second shell 112 are made of rigid materials, in some embodiments, the first shell 111 and the second shell 112 are made of a plastic; and the foldable member 113 is made of a flexible material, in some embodiments, the foldable member 113 is made of a fabric that includes thermal insulation cotton therein. The first shell 111, the second shell 112 and the foldable member 113 cooperatively enclose to form the heating chamber 100, the first shell 111 and the second shell 112 are positioned opposite to each other, that is, the heating chamber 100 is formed between the first shell 111 and the second shell 112. An opening 101 is defined at a top of the heating chamber 100, allowing towels to be placed into the heating chamber 100 from the top of the heating chamber 100. When the first shell 111 and the second shell 112 move toward each other, driving the foldable member 113 to be folded, a capacity of the heating chamber 100 is reduced, such that the towel heating device can be stored conveniently. When the first shell 111 and the second shell 112 move away from each other, driving the foldable member 113 to be unfolded, such that the capacity of the heating chamber 100 is expanded to allow towels to be placed into the heating chamber 100 for drying, heat retention, and so on.

The towel heating device includes at least one installation frame 12, and the at least one installation frame 12 is mounted on either the first shell 111 or the second shell 112. Both the heating plate 2 and the heat insulation member 3 are mounted on the mounting frame 12, such that the heating plate 2 and the heat insulation member 3 are capable of moving with the first shell 111 or the second shell 112. In addition, the mounting frame 12 is configured to separate the heating plate 2 from the shell 11, preventing the heat of the heating plate 2 from being directly transferred to the shell 11, therefore melting of the shell 11 caused by the high temperature of the heating plate 2 can be prevented, and burns when touching the shell 11 can also be avoided. In an embodiment, the installation frame 12 is made of a plastic material that are high-temperature-resistant and flame-retardant.

Figure 5:
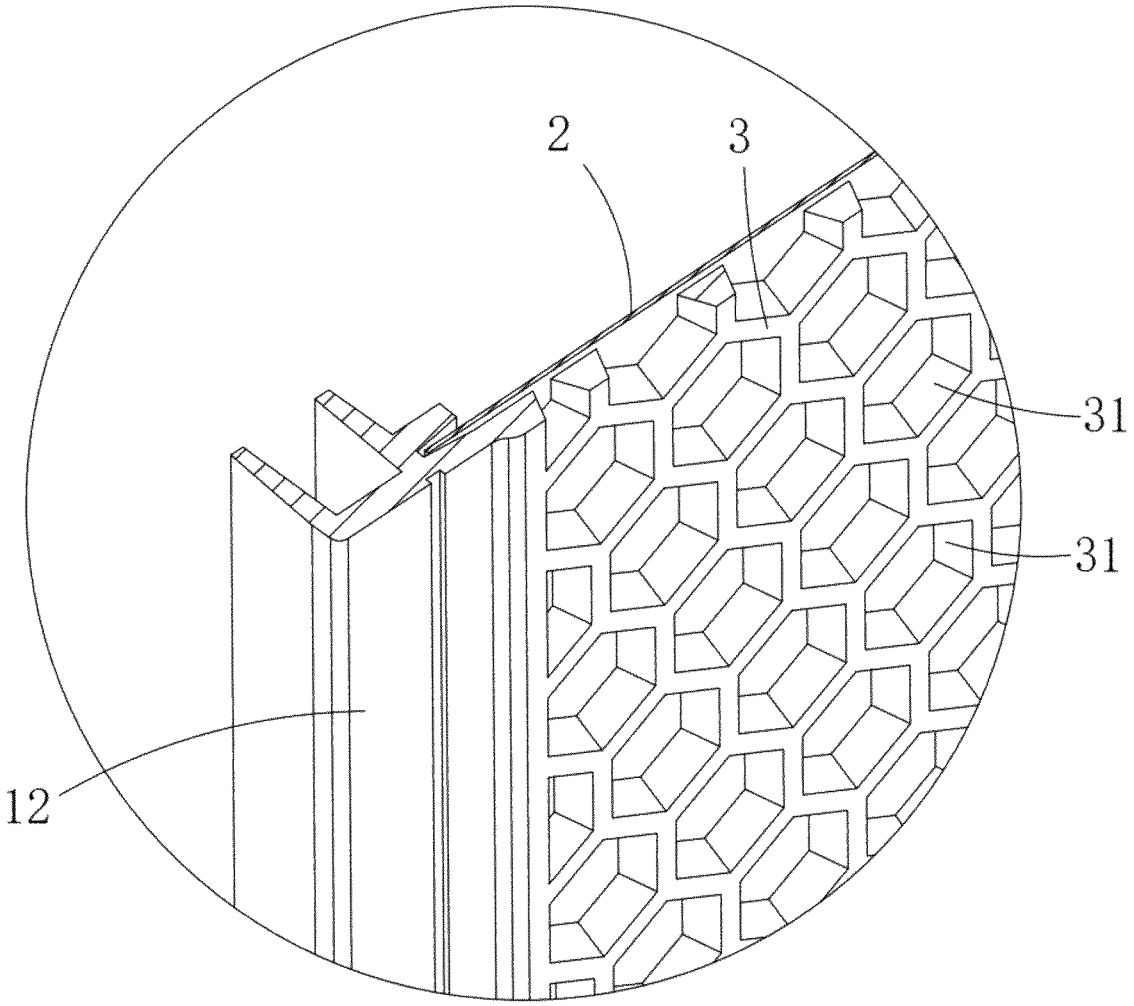
FIG. 5 is a horizontal cross-sectional schematic view of the heat insulation and the heating plate according to an embodiment.

In an embodiment, as shown in FIG. 5, the heat generated by the heating plate 2 needs to be conducted into the heating chamber 100 through the heat insulation member 3. Therefore, in the present embodiment, the heat insulation member 3 is configured to contact the heating plate 2, to prevent an excessively large gap between the heat insulation member 3 and the heating plate 2, which could affect a heat transfer of the heating plate 2. In addition, the material of the heat insulation member 3 is the same as that of the installation frame 12, which is the plastic material with high-temperature resistance and flame-retardant properties.

Regarding the specific structure between the heat insulation member 3 and the installation frame 12, in an embodiment, as shown in FIG. 5, the heat insulation member 3 and the installation frame 12 are configured as an integral and one-piece structure. In another embodiment, which is not illustrated in the figures of the present disclosure, the heat insulation member 3 is connected to an inner side of the installation frame 12 through a detachable connection, for example, through an interference fitting connection, a snap-fit connection or other connections. The difference between the above two embodiments lies only in the installation method and manufacturing cost, which does not affect the function of the heat insulation member 3.

In an embodiment, in order to improve the heating efficiency when the heating plate 2 heating the heating chamber 100 through the heat insulation member 3, a plurality of holes 31 are defined in the heat insulation member 3, allowing the heating plate 2 to directly heat the air inside the heating chamber 100.

The heat insulation member 3 is arranged to fully cover an inner side of the installation frame 12, the plurality of holes 31 on the heat insulation member 3 are arranged in a honeycomb layout, allowing a diameter of each of the plurality of holes 31 to be configured smaller without affecting the heat insulation of the heat insulation member 3. In some embodiments, the heat insulation is entirely made of silicone material, and the heat insulation member 3 does not define any hole 31, that is, the heat insulation member 3 is an integrity board, completely isolating the heating plate 2 from the heating chamber 100. The heat generated by the heating plate 2 can only be transferred to the heating chamber 100 through the heat insulation member 3. The embodiment described above is not depicted in the provided figures.

In order to improve the efficiency of the heating chamber 100 being heated, in some embodiments, the towel heating device includes two heating plates 2. To correspond with the two heating plates 2, two heating insulation boards 3 and two installation frame 12 are provided in the present disclosure, therefore, the heating chamber 100 is formed between the two heating plates 2, with the two heating plates 2 being positioned oppositely to each other.

Figure 6:
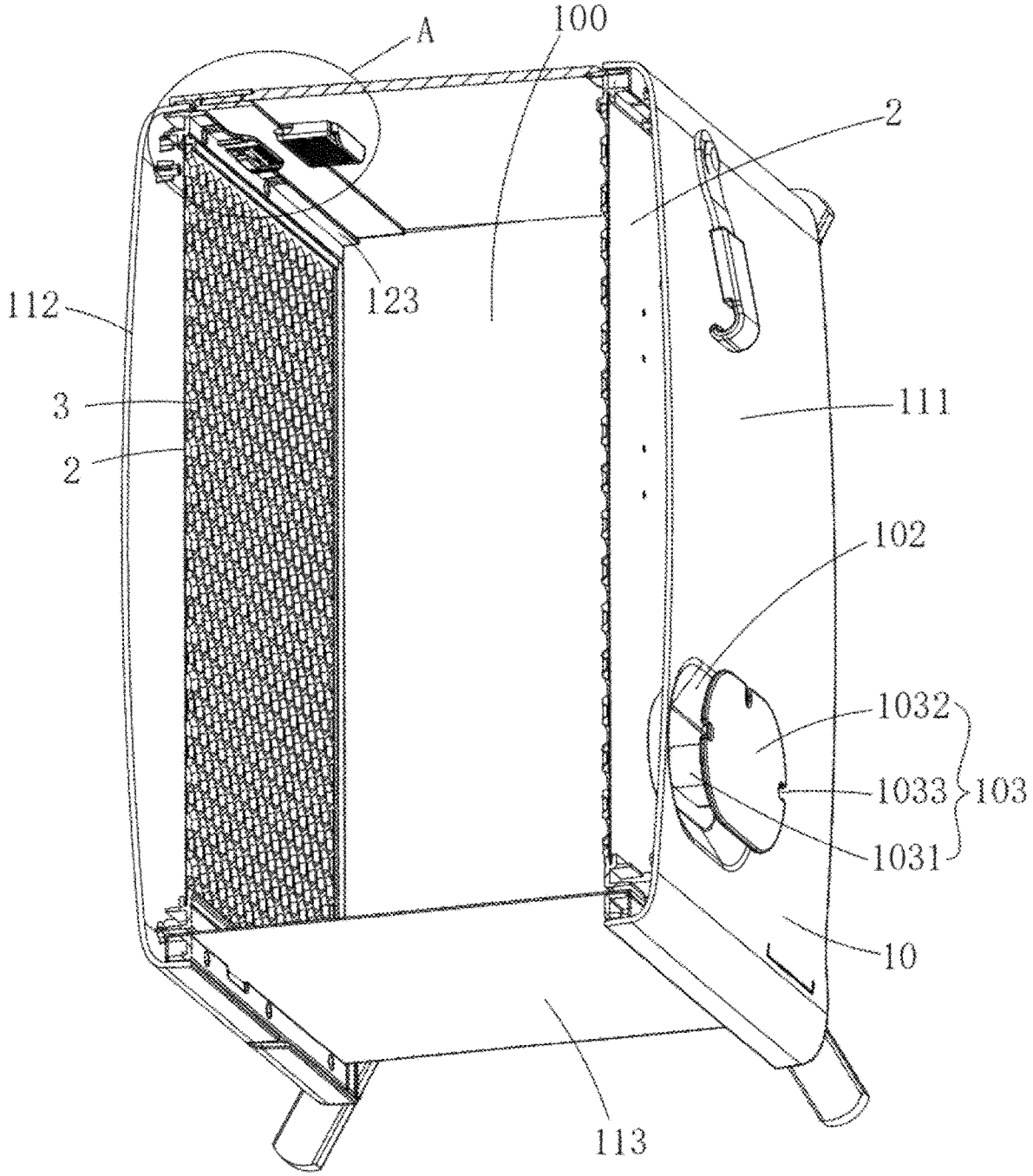
FIG. 6 is a vertical cross-sectional schematic view of the towel heating device.
Figure 7:
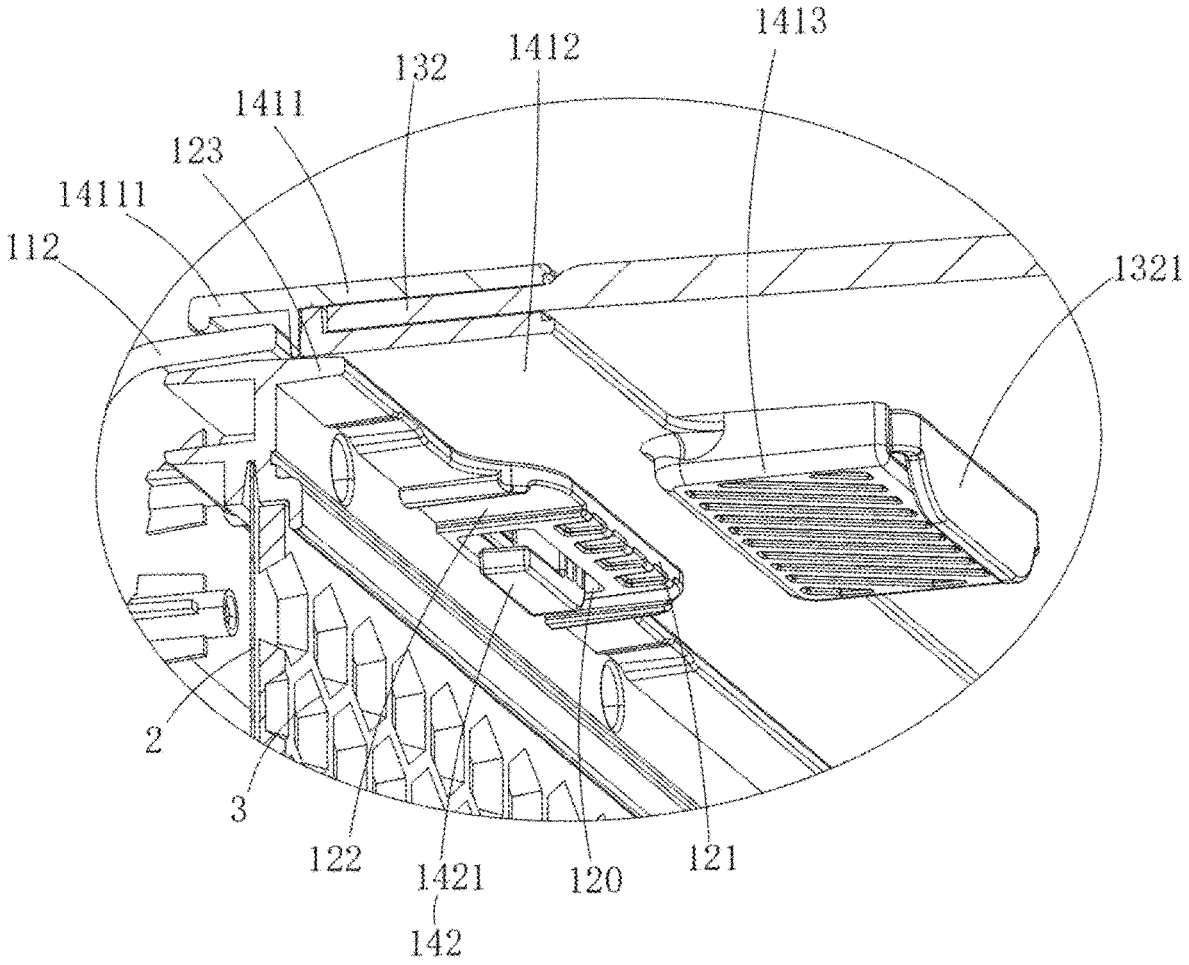
FIG. 7 is an enlarged view of a portion A shown in FIG. 6.
Figure 8:
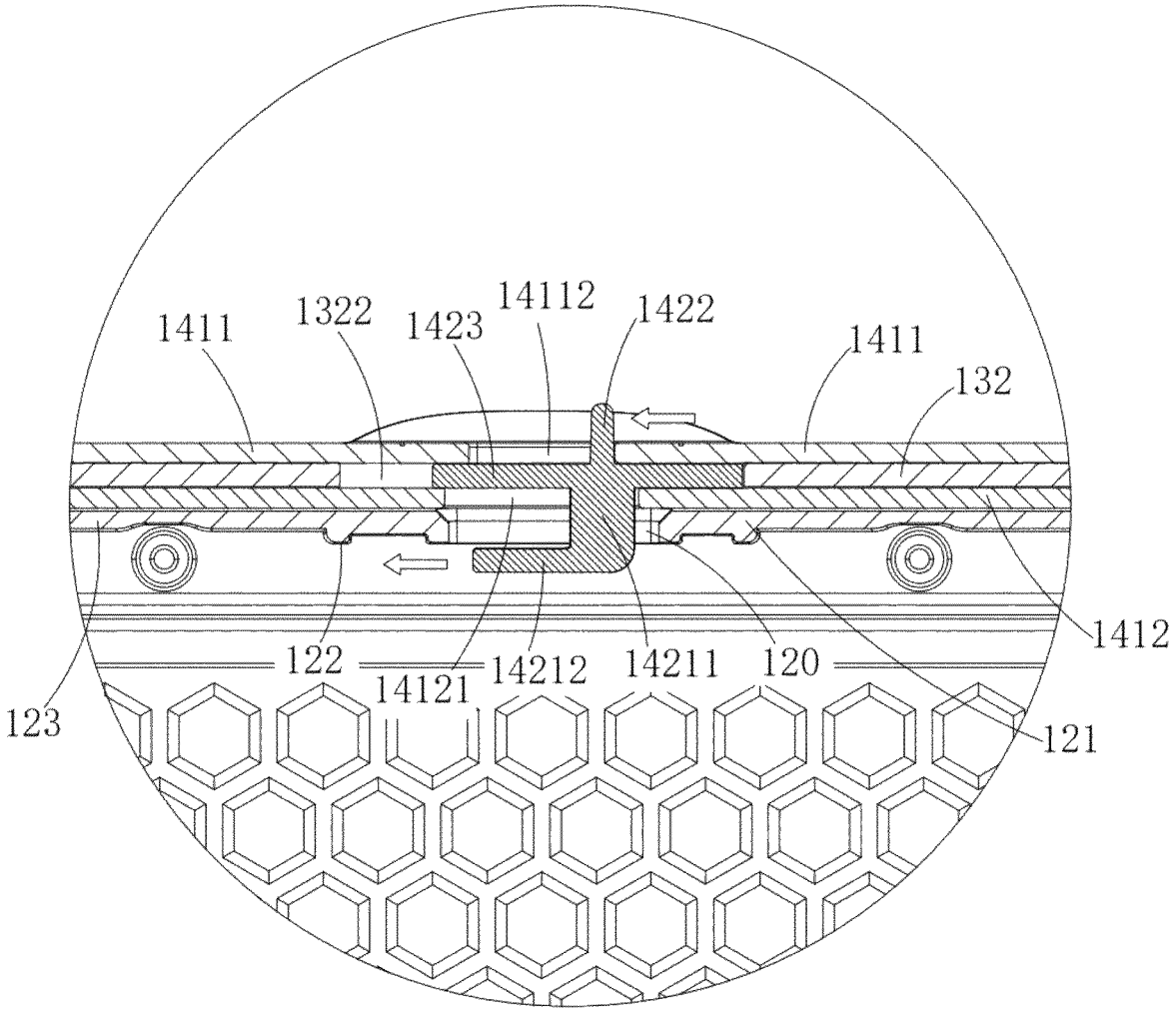
FIG. 8 is a cross-sectional schematic view of a locking structure according to an embodiment.
Figure 9:
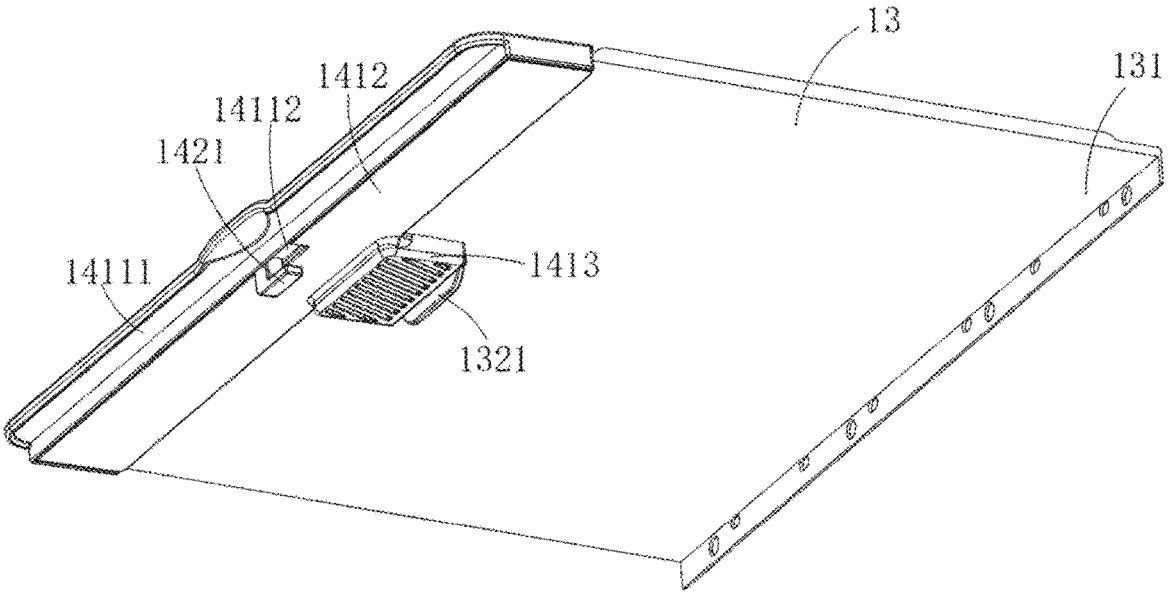
FIG. 9 is a structural view of a cover and the locking structure according to an embodiment.
Figure 10:
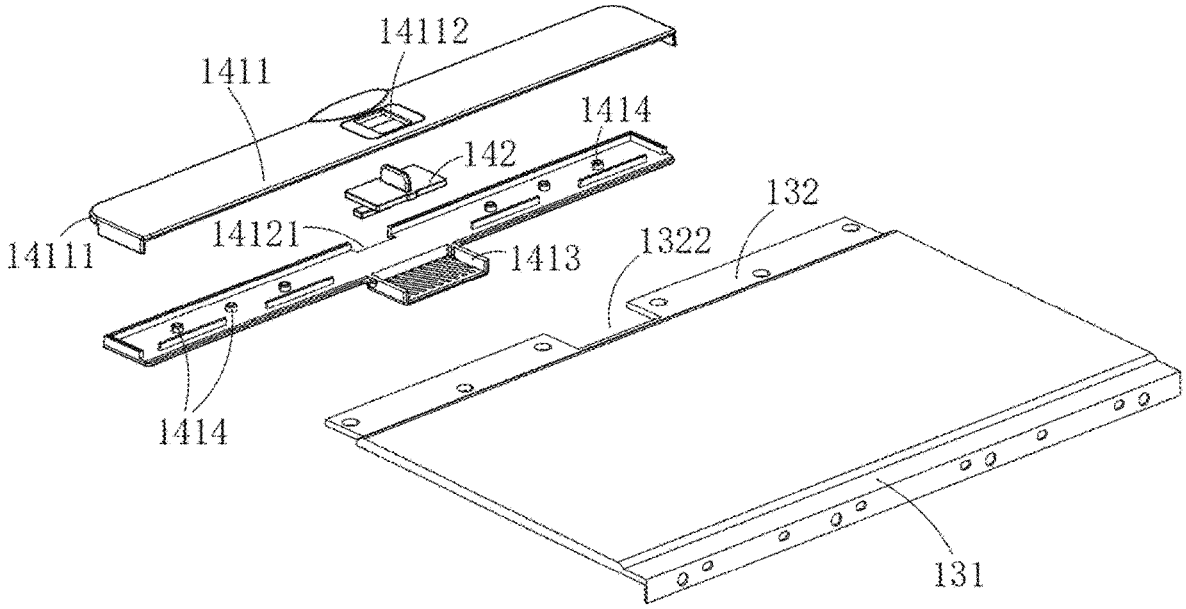
FIG. 10 is a first exploded assembly view of the cover and the locking structure according to an embodiment.
Figure 11:
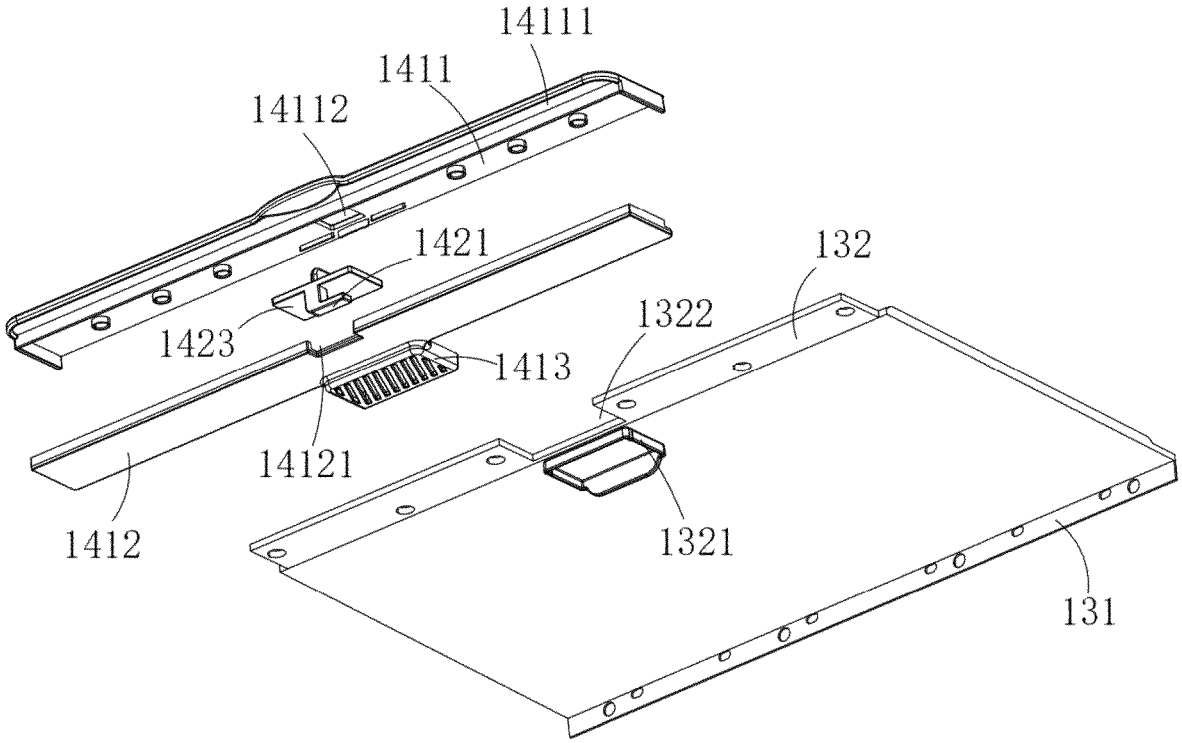
FIG. 11 is a second exploded assembly view of the cover and the locking structure according to an embodiment.

To prevent children from accidentally inserting their limbs into the heating chamber 100, as shown in FIG. 1, FIG. 6 and FIG. 7, in an embodiment, the body portion 1 includes cover 13 and locking structure 14, a first end 131 of the cover 13 is mounted on the first shell 111, the locking structure 14 is mounted at a second end 132 of the cover 13. The locking structure 14 is detachably connected to the second shell 112 or the installation frame 12 inside the second shell 112, to drive the cover 13 to open or close the opening 101. The cover 13 may be implemented by users to seal the heating chamber 100, therefore, on the one hand, a heat loss from the heating chamber 100 is reduced, on the other hand, for children, limbs accidentally entering the heating chamber 100 can be prevented. The cover 13 is made of a flexible material, such as a fabric containing thermal insulation cotton on the inside.

A snap slot 120 is defined in the second shell 112 or the installation frame 12 of the second shell 112. In some embodiments, as shown in FIGS. 2 to 4, and FIG. 7, a connecting protrusion 121 is arranged on the installation frame 12, and a snap slot 120 vertically extends through the connecting protrusion 121, such that, the locking structure 14 is able to extend into the snap slot 120, to achieve a snap-fit engagement.

In an embodiment, as shown in FIG. 1 and FIG. 7, the locking structure 14 includes a connecting base 141 and a sliding hook 142, the sliding hook 142 is slidably mounted on the connecting base 142, the connecting base 141 is connected to the second end 132 of the cover 13, the sliding hook 142 has a hook-shaped bottom 1421, and the hook-shaped bottom is configured to pass through the snap slot and lap over a bottom surface of the connecting protrusion. The connecting base 141 can be placed on the second shell 112 or abut against the installation frame 12 inside the second shell 112, allowing the cover 13 to close the opening 101. The hook-shaped bottom 1421 is located below the connecting base 141 and is configured to pass through the snap slot 120, in this way, moving the sliding hook 142 can drive the hook-shaped bottom 1421 to move beneath the connecting protrusion 121. When an upward pulling force is applied to the connecting base 141, the hook-shaped bottom 1421 abuts against the bottom surface 122 of the connecting protrusion 121, such that, detachment of the connecting base 141 from the second shell 112 is prevented. Therefore, the locking structure 14 can be used to maintain the cover 13 in a locked state.

Regarding the connection structure between the connecting base 141 and the cover 13, as shown in FIG. 7, the connecting base 141 may be configured to clamp the second end 132 of the cover 13. In an embodiment, the connecting base 141 includes an upper base 1411 and a lower base 1412. The upper base 1411 and the lower base 1412 cooperatively clamp the second end 132 of the cover 13, enabling the upper base 1411 to be placed on the second shell 112, with the lower base 1412 lapping over on the second shell 112 and the installation frame 12 inside the second shell 112.

In an embodiment, as shown in FIG. 6 to FIG. 11, an abutment platform 123 is arranged on an upper side of the installation frame 12, protruding toward the heating chamber 100 relative to the second shell 112. The connecting protrusion 121 is formed on the abutment platform 123, the connecting protrusion 121 and the abutment platform 123 are configured as an integral structure. The upper base 1411 is arranged with a lapping plate 14111 protruding in a direction away from the cover 13. When the cover 13 closes the opening 101, the lapping plate 14111 abuts against the second shell 112, and the lower base 1412 abuts against the abutment platform 123.

The sliding hook 142 includes a push-pull portion 1422, a sliding portion 1423, and the aforementioned hook-shaped bottom 1421. The push-pull portion 1422 is formed on an upper side surface of the sliding portion 1423, and the hook-shaped bottom 1421 is formed on a lower surface of the sliding portion 1423. The push-pull portion 1422, the sliding portion 1423, and the hook-shaped bottom 1421 are configured as an integral structure. The sliding portion 1423 is clamped between the upper base 1411 and the lower base 1412. Correspondingly, an avoidance groove 1322 is defined at the second end 132 of the cover 13 to accommodate the sliding portion 1423. A first sliding slot 14112 is defined on the upper base 1411, the first sliding slot 14112 extends in a length direction X of the towel heating device. The push-pull portion 1422 passes through the first sliding slot 14112 and at least a part of the push-pull portion 1422 is exposed to the outside of the connecting base 141. The push-pull portion 1422 is able to slide within the first sliding slot 14112, allowing a user to grip or pinch the push-pull portion 1422 to drive the sliding portion 1423 to slide. A second sliding slot 14121 is defined on the lower base 1412, and the second sliding slot 14121 also extends in the length direction X of the towel heating device. The hook-shaped bottom 1421 passes through the second sliding slot 14121 and is able to slide within the second sliding slot 14121. As shown in FIG. 1, the direction X represents a length direction of the towel heating device, a direction Y represents a width direction of the towel heating device, and a direction Z represents a height direction of the towel heating device.

The hook-shaped bottom 1421 includes a vertical block 14211 and a stopping block 14212 formed on the vertical block 14211. The vertical block 14211 sequentially passes through the second sliding slot 14121 and the snap slot 120, the stopping block 14212 is positioned below the connecting protrusion 121 and extends along the length direction X of the towel heating device. When the lower base 1412 laps over the abutment platform 123, the entire hook-shaped bottom 1421 passes through the snap slot 120, enabling the stopping block 14212 to be positioned beneath the connecting protrusion 121. When an external force is applied to the push-pull portion 1422, causing the hook-shaped bottom 1421 to slide, the stopping block 14212 moves laterally, enabling at least a part of a vertical projection of the stopping block 14212 to overlap with a vertical projection of the connecting protrusion 121. At this point, if the connecting base 141 is lifted upward, the stopping block 14212 can abut against the bottom surface 122 of the connecting protrusion 121 to prevent a further upward movement of the connecting protrusion 121.

In addition, at least one of the upper base 1411 and the lower base 1412 is arranged with a plurality of fixing posts 1414. The plurality of fixing posts 1414 can penetrate through the second end 132 of the cover 13 to enhance the connection strength between the cover 13 and the connecting base 141.

In an embodiment, an engagement base 1413 is arranged on the lower base 1412, and an engagement block 1321 is mounted at a lower surface of the cover 13. When the second end 132 of the cover 13 is clamped between the upper base 1411 and the lower base 1412, the engagement block 1321 also engages with the engagement base 1413, therefore, the connection strength between the second end 132 of the cover 13 and the connecting base 141 can be enhanced and maintained.

Figure 12:
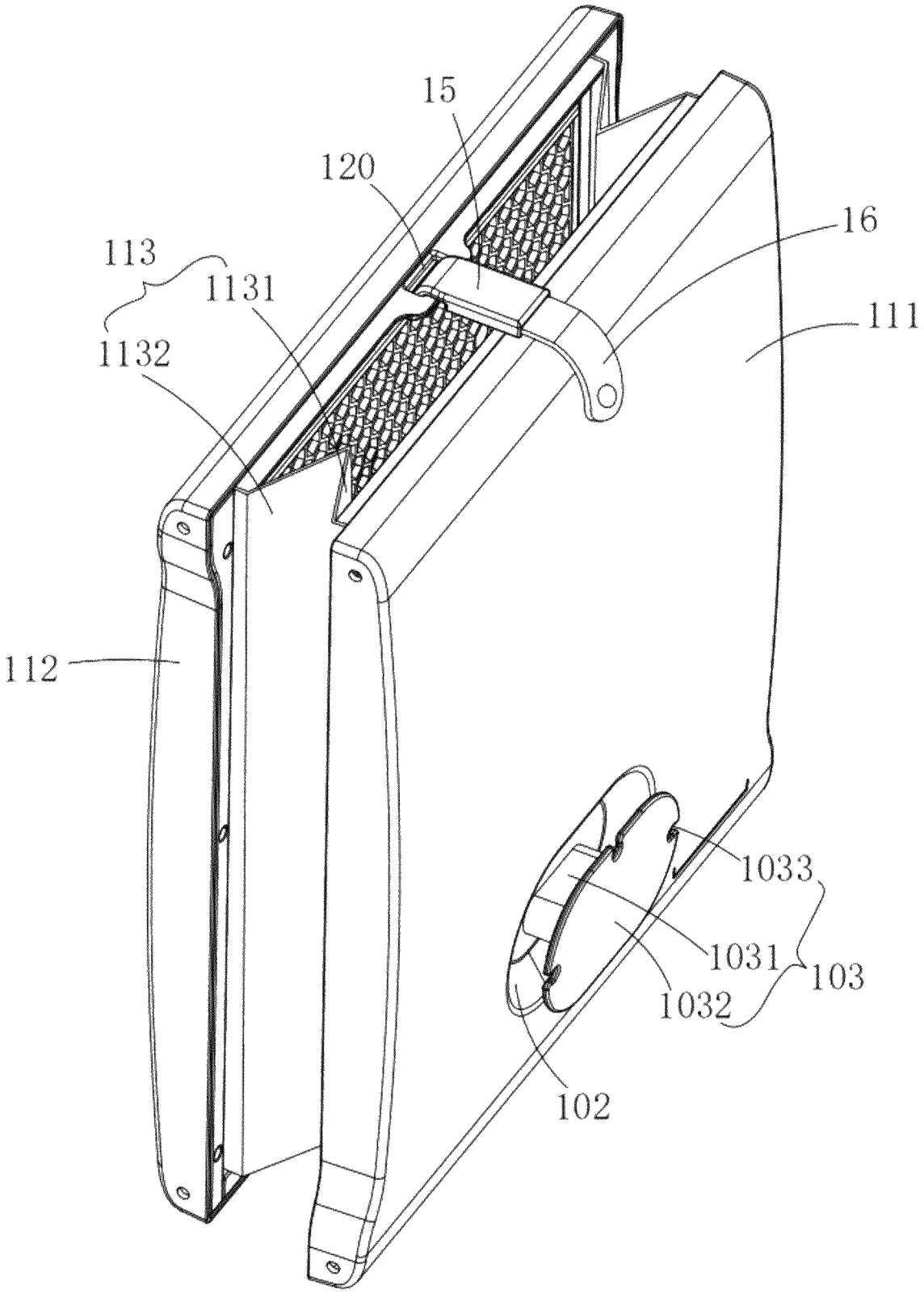
FIG. 12 is a schematic view of a partial structure in a folded state, showing the hook engaged in the snap slot.

In an embodiment, as shown in FIG. 1, FIG. 7, and FIG. 12, the body portion 1 further includes a hook 15, which is movably mounted on the first shell 111. To be more precise, the hook 15 is mounted on the first shell 111 through a section of a rope 16. The hook 15 has a hook-shaped front end, when the locking structure 14 disengages from the snap slot 120, and when the first shell 111 and the second shell 112 are moved toward each other, the hook 15 can be rotated and positioned above the connecting protrusion 121, and therefore the hook-shaped front end of the hook 15 can engage with the snap slot 120. A length of the hook 15 is determined based on a storage state of the towel heating container. When the hook 15 is engaged with the snap slot 120, the first shell 111 and the second shell 112 cannot be moved away from each other, in this way, the storage state of the towel heating container can be maintained reliably.

About the folding structure of the foldable member 113, as shown in FIG. 12, in an embodiment, the foldable member includes a first sheet portion 1131 and a second sheet portion 1132. The first sheet portion 1131 is connected to the first shell 111, and the second sheet portion 1132 is connected to the second shell 112. The first sheet portion 1131 includes an end which is away from the first shell 111, and the second sheet portion includes an end which is away from the second shell 112. The end of the first sheet portion 1131 is connected to the end of the second sheet portion 1132. When the first shell 111 and the second shell 112 move toward each other, the connection between the first sheet portion 1131 and the second sheet portion 1132 moves inward towards the heating chamber 100, to drive the first sheet portion 1131 and the second sheet portion 1132 to fold toward each other. In an embodiment, the first sheet portion 1131 and the second sheet portion 1132 are configured as an integral structure, the integral structure is constructed from a fabric that encloses two dense cotton pads. Alternatively, the first sheet portion 1131 and the second sheet portion 1132 are constructed from a fabric that encloses two wooden boards, the two wooden boards are positioned to mated with the locations of the first panel 1131 and the second panel 1132, facilitating the fold operation of the foldable member 113.

As shown in FIG. 1, a wire winding structure 103 is arranged on an outer wall 10 of the body portion 1. In an embodiment, the wire winding structure 103 is mounted on the first shell 111.

A recessed cavity 102 is defined in the outer wall 10 of the first shell 111, the wire winding structure 103 includes a winding rod 1031 and a baffle 1032 disposed on the winding rod 1031, the winding rod 1031 protrudes from the recessed cavity 102, and the baffle 1032 is located on a side of the winding rod 1031 away from the recessed cavity 102. Therefore, a powder wire of the towel heating container can be wound around the winding rod 1031 and partially accommodated within the recessed cavity 102. The recessed cavity 102 facilitates reducing a protrusion length of the winding rod 1031 from a surface of the first shell 111.

In addition, a plurality of fixation notches 1033 are defined on the baffle 1032. A plug portion of the power wire can be engaged in any of the fixing notches 1033 to secure the power wire, preventing the power cord from becoming disordered.

Obviously, the embodiments described above are only a part of the embodiments of the present disclosure, and not all of them. The accompanying drawings give some embodiments of the present disclosure, but do not limit the patentable scope of the disclosure, which may be realized in many different forms. Rather, these embodiments are provided for the purpose of providing a more thorough and comprehensive understanding of the present disclosure. Although the present disclosure has been described in detail with reference to the foregoing embodiments, it is still possible for a person skilled in the art to modify the technical solutions recorded in the foregoing specific embodiments or to make equivalent substitutions for some of the technical features therein. Any equivalent structure made by utilizing the contents of the specification and the accompanying drawings of the present disclosure, directly or indirectly applied in other related technical fields, are all the same within the scope of the patent protection of the present disclosure.

What is claimed is:

1. A towel heating device, comprising:

a body portion, defining a heating chamber, wherein the body portion comprises a shell and an installation frame fixedly connected to the shell;

at least one heating plate, wherein each heating plate is fixedly mounted on the installation frame; the heating plate has a first side and a second side opposite to the first side; the first side faces the shell; a space is formed between the first side and the shell; the second side faces the heating chamber;

at least one heat insulation member, wherein each heat insulation member is mounted in the heating chamber, the heat insulation member is disposed on only the second side of the heating plate facing the heating chamber;

wherein a plurality of holes is defined in the heat insulation member and arranged in a honeycomb layout for facilitating heat transmission from the heating plate to the heat chamber.

2. The towel heating device according to claim 1, wherein the heating chamber is defined in the shell, the installation frame is mounted inside the shell.

3. The towel heating device according to claim 2, wherein the heat insulation member and the installation frame are configured as an integral and one-piece structure.

4. The towel heating device according to claim 2, wherein the heat insulation member is detachably mounted in an inner side of the installation frame.

5. The towel heating device according to claim 1, wherein the heat insulation member is in contact with the heating plate.

6. The towel heating device according to claim 1, wherein the heat insulation member is made of high-temperature-resistant plastic material.

7. The towel heating device according to claim 1, wherein the heat insulation member is made of silicone material, and configured to separate the heating plate from the heating chamber.

8. The towel heating device according to claim 1, wherein the number of at least one heating plate is two, the heating chamber is formed between the two heating plates, and the number of at least one heat insulation member is two, mating with the two heating plates.

9. The towel heating device according to claim 1, wherein the body portion further comprises a first shell, a second shell, and a foldable member connecting the first shell and the second shell with each other, wherein, the first shell, the heating chamber is formed between the second shell and the foldable member, the first shell and the second shell are configured to move toward or away from each other, driving the foldable member to be folded or unfolded, the heat insulation member is at least mounted on one of the first shell and the second shell.

10. The towel heating device according to claim 9, wherein the body portion further comprises a cover and a locking member, an opening is defined on the top of the heating chamber, a first end of the cover is mounted on the first shell, and the locking member is arranged at a second end of the cover, the locking member is configured to be detachably connected to the second shell or an installation frame inside the second shell, to drive the cover to open or close the opening; the locking member comprises a connecting base and a sliding hook slidably mounted on the connecting base.

11. The towel heating device according to claim 10, wherein a snap slot is defined in the second shell or the installation frame inside the second shell, and the sliding hook is configured to extend into and engage with the snap slot.

12. The towel heating device according to claim 11, wherein the body portion further comprises a hook movably mounted on the first shell, when the first shell and the second shell move toward each other, and the locking member is disengaged from the snap slot, the hook is capable of being engaged with the snap slot.

13. The towel heating device according to claim 9, wherein the foldable member comprises a first sheet portion and a second sheet portion, the first sheet portion is connected with the first shell, the second sheet portion is connected with the second shell, an end of the first sheet portion away from the first shell is connected to an end of the second sheet portion away from the second shell, when the first shell and the second shell move toward each other, a connection between the first sheet portion and the second sheet portion moves toward the heating chamber, to drive the first sheet portion and the second sheet portion to fold toward each other.

14. The towel heating device according to claim 1, wherein a wire winding member is arranged on an outer wall of the body portion and comprises a winding rod and a baffle disposed on the winding rod.

15. The towel heating device according to claim 14, wherein a recessed cavity is defined in the outer wall of the body portion, and the winding rod extends outward from the recessed cavity, with a portion of the winding rod remaining inside the recessed cavity, and the baffle is located on a side of the winding rod away from the recessed cavity.

16. The towel heating device according to claim 15, wherein a plurality of fixation notches are defined on the baffle.

17. A towel heating device, comprising:

a body portion, defining a heating chamber, and an opening being defined on the top of the heating chamber;

at least one heating plate, wherein each heating plate is mounted in the body portion;

the body portion comprising an installation frame, a cover, and a locking member, wherein the heating plate is mounted on the installation frame, a first end of the cover is connected to the body portion, and the cover is configured to open or close the opening, and the locking member is arranged at a second end of the cover and detachably connected to the installation frame;

wherein a connecting protrusion is arranged on the installation frame, and a snap slot vertically penetrates the connecting protrusion;

wherein the locking member comprises a connecting base and a sliding hook, the sliding hook is slidably mounted on the connecting base, the connecting base is connected to the second end of the cover, the sliding hook has a hook-shaped bottom, and the hook-shaped bottom is configured to pass through the snap slot and abut against a bottom surface of the connecting protrusion.

* * * * *